United States Patent [19]

Lovie

[11] 3,967,457

[45] July 6, 1976

[54] SELF-ELEVATING OFFSHORE DRILLING UNIT LEGS

[75] Inventor: Peter M. Lovie, Houston, Tex.

[73] Assignee: Engineering Technology Analysts, Inc., Houston, Tex.

[22] Filed: July 11, 1974

[21] Appl. No.: 487,574

[52] U.S. Cl. ..... 61/46.5; 61/53; 52/731; 74/29; 254/106

[51] Int. Cl.[2] ..... E02B 17/00; F16H 19/04

[58] Field of Search ..... 61/46.5, 46, 53; 52/731, 638, 726, 720; 37/73; 74/29; 254/106

[56] References Cited

UNITED STATES PATENTS

| | | | |
|---|---|---|---|
| 2,578,364 | 12/1951 | Maxon, Jr. | 52/638 X |
| 3,183,676 | 5/1965 | Le Tourneau | 61/46.5 |
| 3,372,907 | 3/1968 | Smulders et al. | 61/46.5 |
| 3,445,129 | 5/1969 | Penote | 52/638 |
| 3,779,656 | 12/1973 | Guy et al. | 52/638 |

FOREIGN PATENTS OR APPLICATIONS

| | | | |
|---|---|---|---|
| 511,789 | 6/1952 | Belgium | 52/726 |
| 921,439 | 1/1947 | France | 52/731 |

*Primary Examiner*—Jacob Shapiro
*Attorney, Agent, or Firm*—Torres & Berryhill

[57] ABSTRACT

Leg apparatus for an offshore drilling unit of the self-elevating type having a floatable hull and a plurality of legs movable from a raised position, in which the legs are supported by the hull in a body of water, to a lowered position, in which the hull is supported by the legs on the floor of the body of water. The legs may comprise a plurality of mutually parallel tubular chord members rigidly interconnected by structural bracing members. The tubular chord members may comprise an elongated tubular body and an elongated plate member, whose longitudinal axis coincides with the axis of the tubular body, rigidly connected to and spanning the interior of the tubular body.

17 Claims, 10 Drawing Figures

FIG. 3
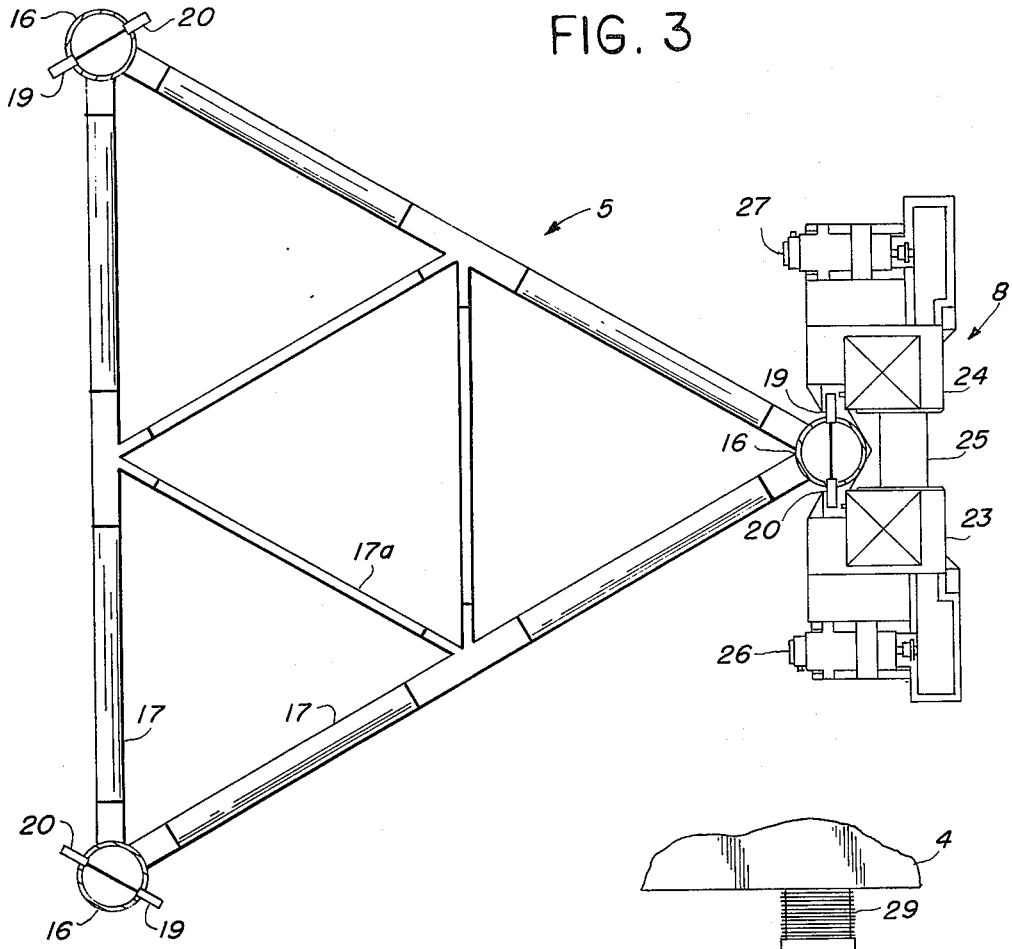
FIG. 4
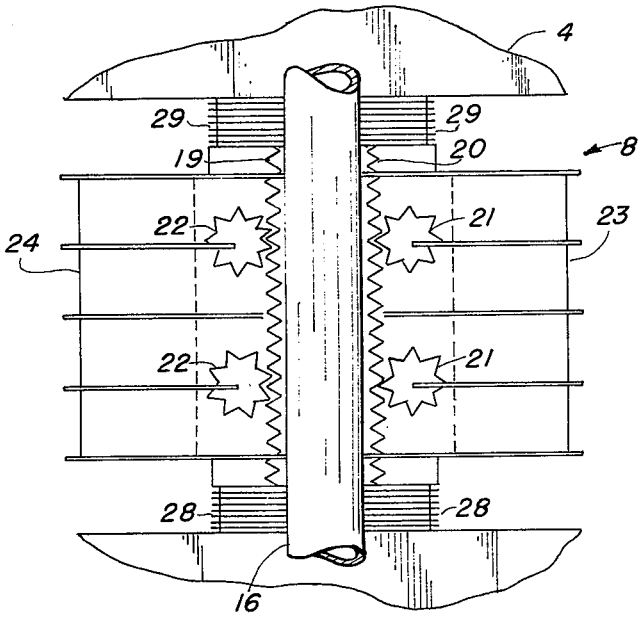
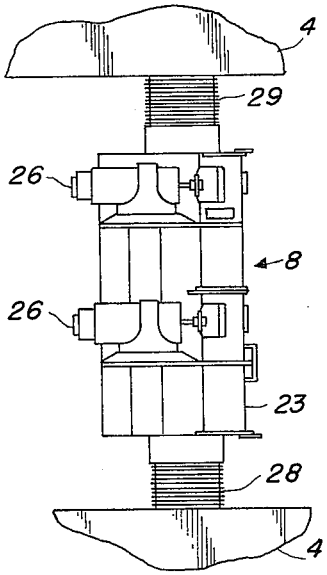
FIG. 5

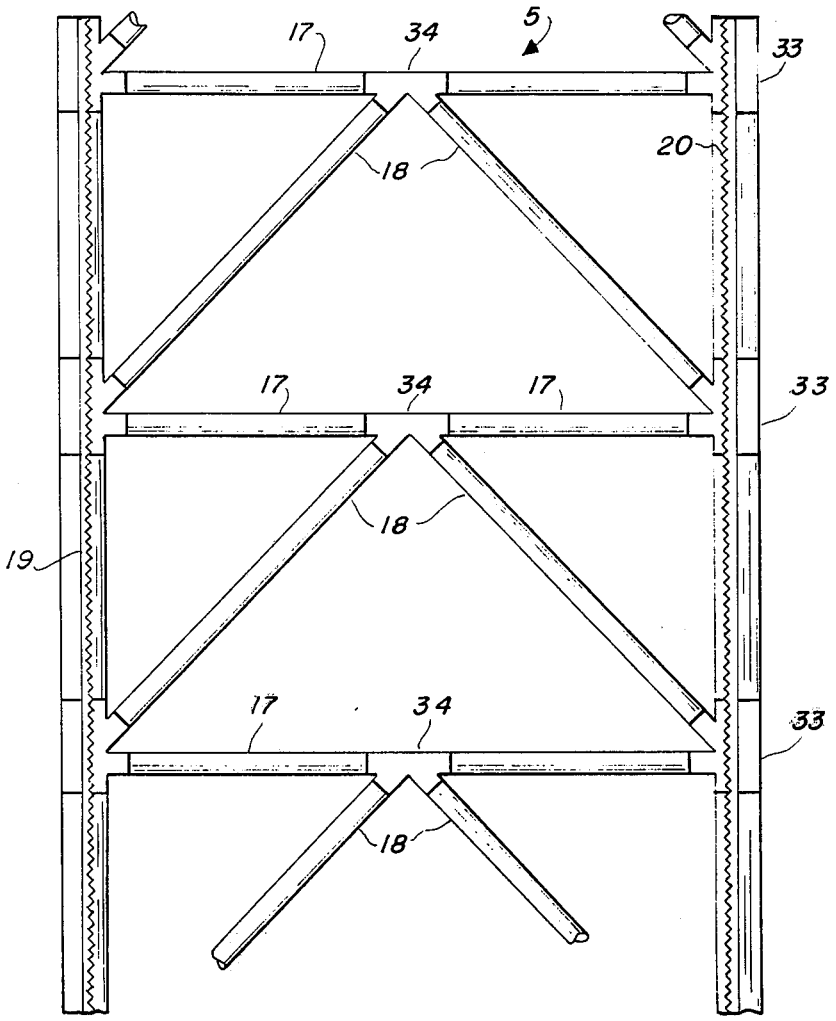
FIG. 6
FIG. 7
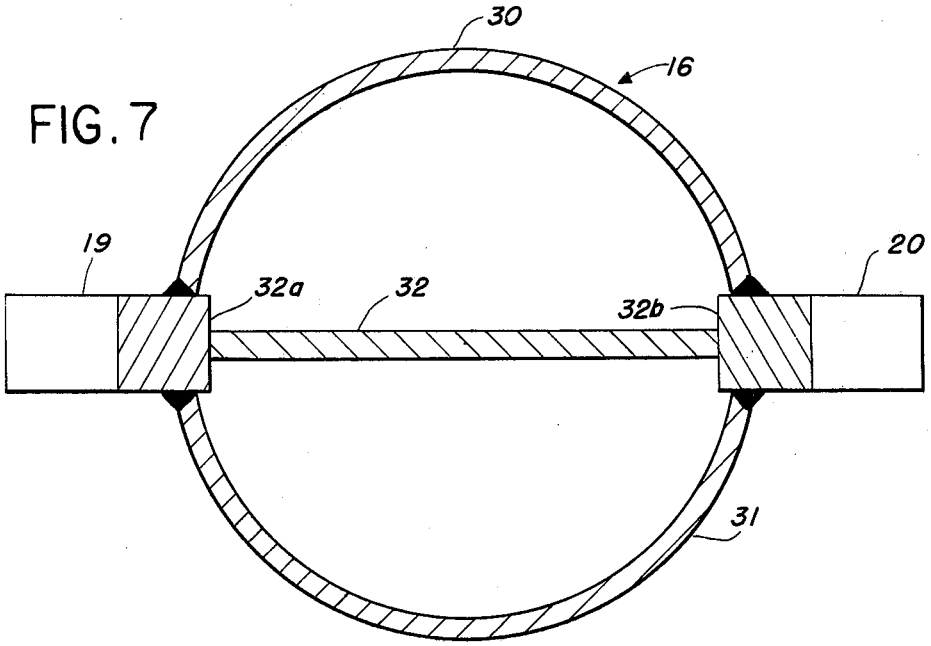

SELF-ELEVATING OFFSHORE DRILLING UNIT LEGS

BACKGROUND OF THE INVENTION

1. Field of the Invention

The present invention pertains to offshore drilling units. In particular, it concerns offshore drilling units of the self-elevating type having a floatable hull and a plurality of legs movable from raised positions, in which the legs are supported by the hull in a body of water, to lowered positions in which the hull is supported by the legs on the floor of the body of water. More specifically, the present invention pertains to unique and improved construction for the legs of such a drilling unit.

2. Description of the Prior Art

There are several different types of rigs by which marine drilling is conducted. One of the first developed was the fixed platform rig in which the legs or supports of the rig are permanently installed, penetrating the floor of the body of water in which the well is to be drilled. Such a rig is limited by water depth and does not provide the mobility and flexibility of the mobile or portable type drilling rigs. For very deep water drilling, floating platforms or drill ships may be used. Depending upon the situation, drilling operations may also be conducted from submersible, semi-submersible, or self-elevating platform drilling units.

For use in water depths up to three hundred feet, and lately up to six hundred feet, the self-elevating platform or "jack-up" rig is quite popular. Such a rig is usually provided with a plurality of legs, frequently three or four in number, which are lowered from a floating platform or hull into the water for penetration of the water body floor. The platform is then elevated on the legs a sufficient distance above the water surface to prevent the platform from being subjected to wave action. Such rigs offer the advantage of being highly mobile, yet very stable when in place.

Some of the major design considerations in a self-elevating drilling rig are the construction of the legs and the means for elevating the platform or hull on the legs. Since the legs support the entire unit when in place, they must be designed for a great amount of strength and minimal effect from the constantly changing wave conditions. Three or four legged units, in which the legs comprise mutually parallel chord members interconnected by structural bracing members are popularly employed. The bottom of the legs are provided with spud feet or spud tanks for footing penetration of the floor of the body of water in which the unit is to be used. Examples of such units may be seen in U.S. Pat. Nos. 3,044,269 and 3,606,251.

One method of moving the legs between raised and lowered positions is to provide suitable rack and pinion arrangements. The pinions, which may be driven by powered elevating or jack units on the hull of the ship, are engageable with racks attached along the chord member of the legs. Rotation of the pinions causes the racks, and consequently the legs, to move in a vertical direction within wells provided in the hull. Such elevating mechanisms are shown in the above-mentioned U.S. Pat. Nos. 3,044,269 and 3,606,251. Others are shown in U.S. Pat. Nos. 2,924,077 and 3,014,346.

In the past, the legs of most jack-up drilling units have been constructed either in cylindrical form or as a "space frame" made up of angles, "I" beams or prismoidal structural of trapezium of tubular section. More recently, the legs have been constructed predominantly of tubular structural members. In any case, the vertical members or "chords", as they are sometimes referred to, are usually rigidly interconnected by horizontal and inclined or diagonal bracing members which are welded thereto. It is very difficult to obtain good welds under such circumstances and very often stress concentration points are created at points of the welds. Past experience has led to cracking and sometimes failure at such connections particularly in areas where severe loadings occur, often involving fatigue effects. This is particularly true in tubular construction, since the tubular members must be cut in such a fashion as to conform closely with curvilinear surfaces of another tubular member or quadrilateral sectioned member at inclined angles thereto.

The welding process causes imputs of heat to the structural sections which can easily cause distortion. Such "out of straightness" has frequently been a problem in jackup leg construction in prior art units, particularly when assymmetric leg chord sections are used. The symmetry and construction used have greatly reduced such problems.

In an effort to overcome some of the welding and stress concentration problems involved in connecting horizontal and diagonal bracing to the chord members of legs, preformed joints have been developed. An example of developments in this may be seen in U.S. Pat. Nos. 3,596,950 and 3,668,876.

Since the legs support the entire weight of the rig, when in position for drilling, they are required to be designed for great strength. When supported on the floor of a body of water, the greatest bending moments in the legs occur near the hull or platform. This means that the chord members must necessarily be stronger near the upper portion of the leg. In legs which use tubular chord members this requires that the wall thickness of the tubular members increase from the bottom of the leg upwardly. Non-uniform wall thickness of the chord member creates problems in construction of legs. For example, welds are harder to make and points of stress concentration are created. If the tubular chord members are not reduced in wall thickness toward the bottom of the legs, the unnecessary increased metal results in greater weight of the legs and increased costs thereof. Greater weights are particularly undesirable when the legs are in the raised, in-transit position, since the center of gravity of the unit is raised making the rig less stable in the water.

When a rack is welded to chord members, additional forces of the drive pinion requires additional strength in the chord member. Although the welding of longitudinal racks to the chords of a leg may increase the strength thereof, most jack-up rig legs depend upon the wall thickness of the chord member and the interconnecting bracing for strength.

Development continues in offshore drilling rigs in an attempt to build more economical, efficient and trouble free units. Since drilling is taking place in deeper and deeper water, floating rigs and self-elevating platform rigs are in the forefront of this development.

SUMMARY OF THE PRESENT INVENTION

In the present invention a unique leg construction is shown for a self-elevating type drilling unit. The legs may comprise a plurality of mutually parallel tubular chord members rigidly interconnected by structural bracing members. The tubular chord members may comprise an elongated tubular body on the interior of which is longitudinally disposed an elongated plate member, which lies in a plane including the longitudinal axis of the tubular chord member, rigidly connected to and spanning the interior of the tubular body.

In a preferred embodiment, the tubular body may be formed by two semi-cylindrical, rolled plates between the ends of which are welded rack members. The internal reinforcing plate may be welded to the backs of the rack members in a common plane therewith. The thickness of the plate member can be varied, depending on where it is located along the legs. Thus, it is not necessary to vary the wall thickness of the cylindrical chord body. This solves several problems:

a. the uniform wall thickness of the chord member makes welding easier and more reliable;
b. the thickness of the metal from which the chord body is rolled can be selected for easy rolling, whereas greater thicknesses which might otherwise be required would either not be so easy to roll or would be totally impossible to roll with commercially available equipment;
c. the increased forces applied by the rack and pinion drive can be borne directly by the internal reinforcing plate thus greatly decreasing radial deflections and making for reliable rack/elevating unit performance;
d. smaller diameter chord members can be used; and
e. the racks and the diametral plate connecting them can be welded together easily using simple jigs and automatic welding techniques is desired, and rotating the section for successive weld passes to minimize welding distortion. The use of the approximately semicylindrical sections also allows easy use of automatic welding and rotation for successive welds to minimize welding distortion.

In addition, preferred embodiments of the invention may be provided with chord joint castings and brace castings for interconnection of the chords and bracings. The chord castings which are welded between sections of the chord may comprise a tubular trunk and branches or stubs which project for welding to the ends of horizontal and diagonal bracing. K-shaped cast joints may be provided for connecting horizontal braces to inclined or diagonal braces.

By providing such cast joints, many of the problems associated with leg fabrication can be eliminated. For one thing, areas of load concentration can be "beefed up" in the casting process to provide locally stiffened (and strengthened) areas to resist these concentrated loads. Radii can be provided at the intersections of the stretched members in order to reduce stress concentrations: this can have the effect of reducing stress concentration factors from the order of 2.5 to 4.0 down to the order of 1.2 to 1.5. Furthermore, the casting can be performed in such a manner as to have the metal grains oriented in the most desirable direction for strength. In addition, simple butt joint welding may be made between the cast joints and the associated tubular chord or bracing members. Thus, much more uniform, simpler and reliable welds can be made, as well as simplifying the end preparation of the tubular members to straight cuts. Since the tubular bracing members are inserted with straight cut ends, the overall leg structure may easily be constructed using jigs. Assembly of two bay or larger sections into the overall leg structure is also simplified.

In summary, legs constructed according to the present invention provide greater strength with less weight and efficient fabrication. Such legs are less likely to have areas of high stress concentration and are less likely to have defective welds. Because of the absence of the relatively high stress concentration factors occurring in conventional construction, the structure is less sensitive to the effects of defective welds, thus making for reliable, safe performance. They are also highly adaptable for attachment of racks by which the legs can be moved between raised and lowered positions with pinions of suitable elevating units carried by the hull. Further objects and advantages of the invention will become apparent from the description which follows in conjunction with the accompanying drawings.

BRIEF DESCRIPTION OF THE DRAWINGS

FIG. 3, taken along line 3—3 of FIG. 1 is a horizontal cross section of one of the legs of the unit of FIGS. 1 and 2, also illustrating the relationship of an elevating unit with one of the leg chord members;

FIG. 4, taken along line 4—4 of FIG. 3, is an elevational view further illustrating the relationship between the elevating unit and corresponding leg chord member;

FIG. 5, taken along line 5—5 of FIG. 3, is a side elevation view of the elevating unit of FIGS. 3 and 4;

FIG. 6 is a partial elevation view of a leg member, constructed according to a preferred embodiment of the invention;

FIG. 7, taken along line 7—7 of FIG. 6, is a cross section of one of the chord members of the leg;

DESCRIPTION OF PREFERRED EMBODIMENTS

Figure 1:
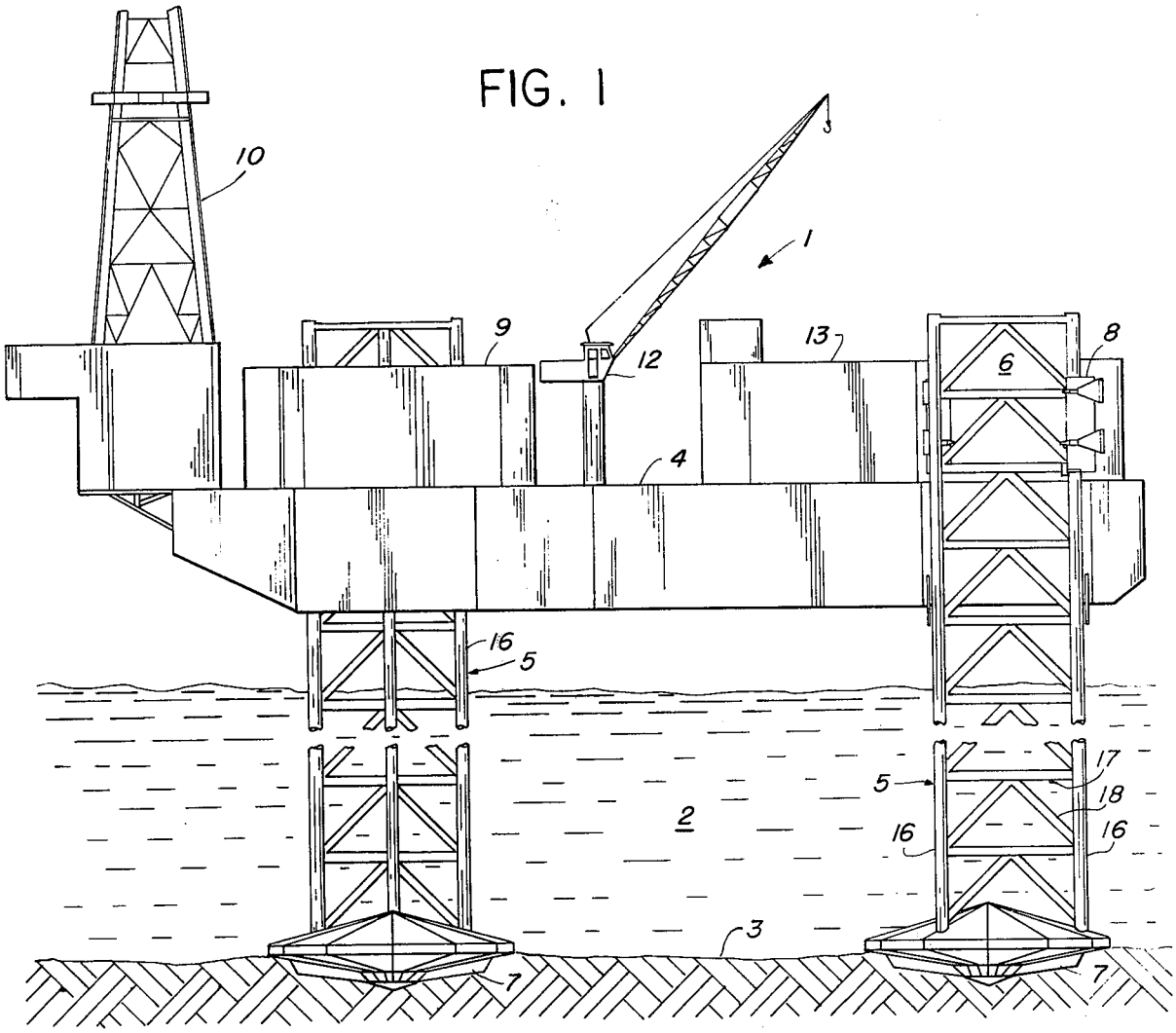
FIG. 1 is a side elevation view of a self-elevating type drilling unit employing legs constructed according to a preferred embodiment of the invention, a portion of the unit hull being broken away for a better understanding thereof.
Figure 2:
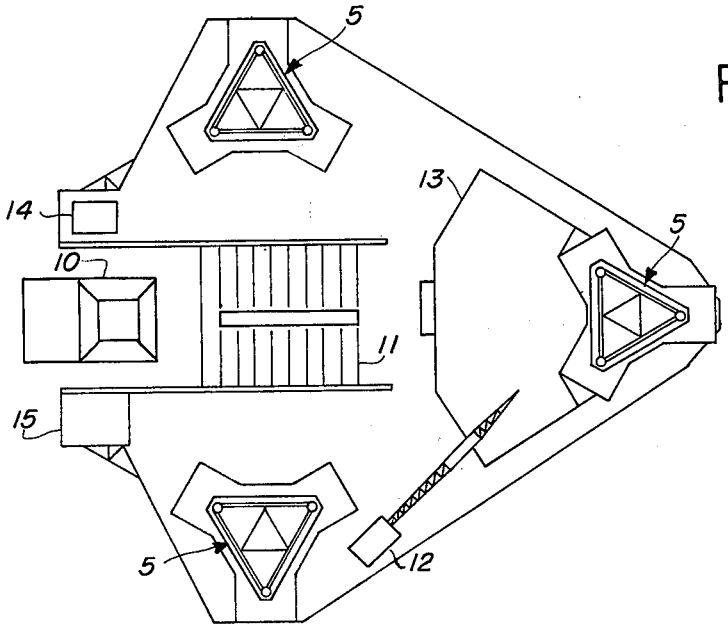
FIG. 2 is a plan view of the drilling unit of FIG. 1, illustrating location of the legs and layout of the main deck.

Referring first to FIGS. 1 and 2, there is generally shown a drilling rig 1 of the self-elevating platform type. The rig is depicted as being on location at a drilling site in a body of water 2 having a floor 3. The rig comprises a floatable hull 4 and a plurality of legs 5. Although any number of legs may be used, there are three such legs 5 in the particular rig shown. These legs 5 are vertically movable, within wells 6 provided in the hull 4, from raised positions, in which the legs are supported by the floating hull, to the lowered positions shown in FIG. 1, in which the hull 4 is supported on the legs 5. Each of the legs 5 may be provided with spud tanks or feet 7 for penetrating and bearing against the floor 3 for support of the rig.

To move the legs 5 between the raised and lowered positions, a plurality of elevating units or jacks 8 are carried on the hull 4. These units may be enclosed within jack houses 9. The elevating or jack units 8 are provided with pinions which operatively engage cooperating racks attached to the legs 5 to provide the means for raising and lowering the legs 5. These components will be more fully described hereafter. For the present, it is sufficient to understand that the drilling rig 1 is transported to a drilling location with the legs elevated and the hull floating on the water. Once the drilling site is reached, the legs are lowered by the jack units 8 until spud tanks 7 engage the floor 3. Further operation of the jack units 8 causes the hull 4 to be elevated on the legs 5 to a sufficient height above the surface of the water body 2. From this position the drilling takes place.

Mounted on the hull or platform 4 is a derrick 10 from which wells are drilled. The derrick may be mounted for limited lateral movement in two directions so that it can be centered over a plurality of locations, permitting a number of wells to be drilled from the platform without changing the position of its legs 5. Auxiliary drilling equipment such as pipe racks 11, crane 12, etc. may be provided on the hull or platform 4. Additional support facilities such as quarters 13, test laboratories 14 and 15, etc. may also be provided.

Referring also to FIG. 3, each of the legs comprises a plurality, three in the present case, of mutually parallel chord members 16 rigidly interconnected by major horizontal and inclined or diagonal bracing 17 and 18, respectively. Smaller interior bracing 17*a* may also be provided. Further details of the chords 16, bracing 17 and 18 and their interconnection will be given hereafter. As best seen in FIG. 3, the chord members 16 are located at the points of triangular cross-sectional configurations of the legs. The number of chords and cross-sectional configuration is, however, not so limited.

Each of the chord members 16 is provided with a pair of rack members 19 and 20 longitudinally disposed therealong in a plane passing through the axis of chords 16 and parallel to but spaced from the central axis of the leg member 5. The outward edge or face of racks 19 and 20 are provided with rack teeth which cooperatively engage pinions carried by the elevating or jack units 8. (See also FIGS. 4 and 5.) Although only one jack unit 8 is shown in FIG. 3, there would normally be one for each chord member 16.

The jack units 8 are carried on the hull 4 within the jack houses 9 and each jack unit may comprise a pair of gear assemblies 23 and 24 rigidly connected by a structural member 25. The gear assemblies may also be provided with power means 26 and 27 such as hydraulic or electric motors. The jack unit may be provided with resilient pads 28 and 29 for absorbing the shock forces to which they be submitted. Since the jack units 8 are retained against vertical displacement by the hull, it can readily be understood that upon operation of the power means 26 and 27, causing rotation of pinions 21 and 22, the legs 5 will be raised or lowered depending upon the direction of rotation of pinions 21 and 22.

Referring now to FIGS. 6–10, specific details of the legs 5, according to a preferred embodiment of the invention, will be given. As already stated, the legs 5 may comprise a plurality of mutually parallel chord members 16 rigidly interconnected by horizontal and diagonal bracing 17 and 18. Also, as previously described, rack members 19 and 20 may be longitudinally disposed along the chord member 16.

The construction of chord members 16 is unique. As best seen in FIG. 7, the chord member 16 is tubular and may comprise a pair of semi-cylindrical members between the ends of which are welded the rack members 19 and 20. Spanning the interior of chord member 16 in a plane including the axis of chord member 16 and coinciding with the plane of rack members 19 and 20 is an elongated reinforcing plate member 32. The plate member may be welded along its edges, as at 32*a* and 32*b*, to the backs of rack members 19 and 20.

This internal reinforcing plate member is unique in the construction of drilling rigs and serves vital functions. It, of course, strengthens the chord member 16 against the normal compression, tension and bending forces to which the legs 5 are subjected. In addition, it strengthens the chord member 16 against the forces to which it is subjected from the rack and pinion mechanisms for raising and lowering the legs. One interesting advantage of such construction is that the design strength of the chord member 16 can be varied, without varying the wall thickness of the cylindrical portions 30 and 31, by simply varying the thickness of the reinforcing plate 32. Since the forces on the chord member 16 may vary, depending upon its position in the leg 5, the thickness of the plate 32 may be varied accordingly. This permits the cylindrical portion to be uniform throughout the length of the leg making welding of the chord member easier, more reliable and less subsceptible to stress concentration. Furthermore, the plate selected for rolling and forming the semi-cylindrical members 30 and 31 can be selected of a more easily rolled thickness and smaller diameter chord members can be used.

From FIG. 6, it will be noted that preformed joints 33 and 34 are employed in interconnecting the various sections of chord members 16 and horizontal and diagonal bracing 17 and 18, respectively. These joints may be conveniently performed by casting or other suitable methods in configurations shown in FIGS. 8–10.

Figure 8:
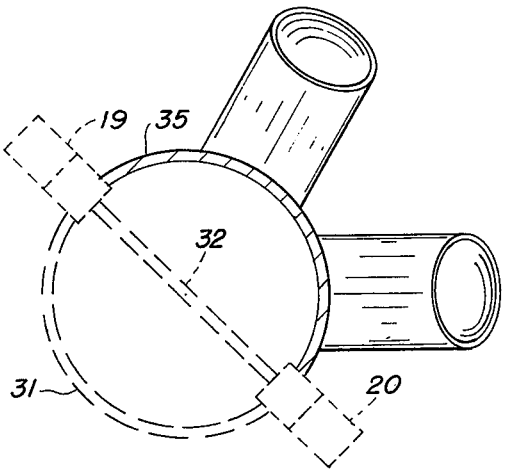
FIG. 8 is a top view of a cast joint for connection in chord members of the leg of FIG. 6.
Figure 9:
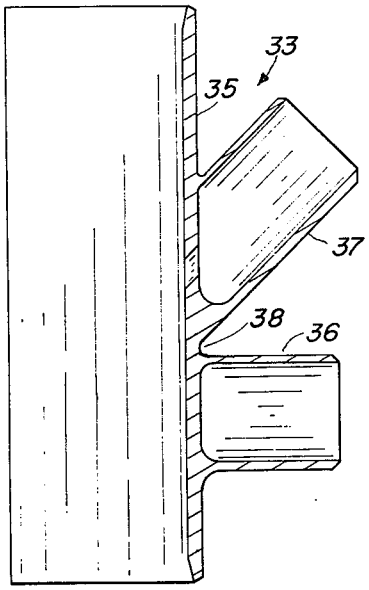
FIG. 9 is an elevational view of the joint casting of FIG. 8.

The chord joint 33, as shown in FIGS. 8 and 9, may comprise a cylindrical trunk or body portion 35 and one or more tubular projections or branches 36 and 37. The horizontal branches 36 are provided for connection with horizontal bracing 17 while the inclined branches 37 are provided for connection with inclined or diagonal bracing 18. The body or trunk portion 35 may be approximately semi-cylindrically cast for welding to a semi-cylindrical section 31, rack members 19 and 20, and internal reinforcing plates 32, such as those shown in the chord cross-section of FIG. 7, and may actually be a continuation thereof.

By casting such a joint, areas of heavy stress concentration, such as the area 38 may be beefed up or reinforced in a way not permissible with conventional construction techniques. Furthermore, the open ends of the branch projections 36 and 37 lie in a plane perpendicular to the axes of these projections and the tubular bracing to which they are to be welded so that a simple circular butt weld may be made, rather than the complex curvature welds required when one tubular member is connected to another tubular member as in the prior art.

Figure 10:
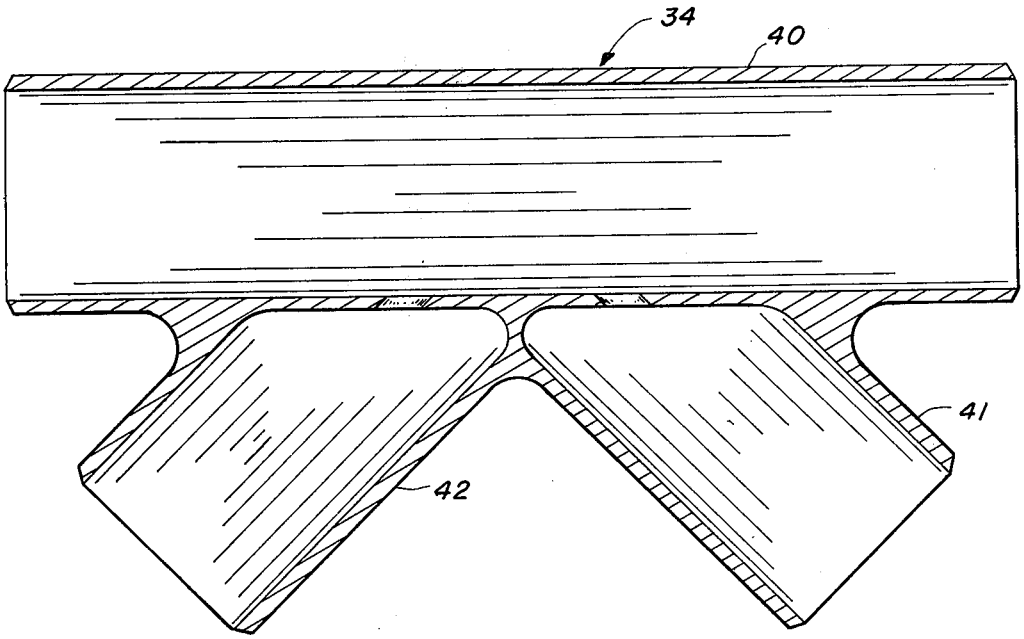
FIG. 10 is a side elevation view of a K-shaped cast joint for interconnection of horizontal and diagonal bracing of the leg of FIG. 6.

Similarly, the brace joints 34 may be cast as shown in FIG. 10. Such a K-shaped joint may comprise a tubular body or trunk portion 40, which will normally be in the horizontal position, and inclined tubular branch projections 41 and 42. The K-shaped bracing joint 34 offers the same advantages of the chord joint 33, namely easier and more reliable welding and strengthening of areas of high loading concentration, as well as reducing stress concentrations through the use of radii at the intersections of the structural members.

From the foregoing description it can be seen that the leg construction of the present invention offers substantial advantages over leg constructions of the prior art. Legs so constructed provide greater strength, more reliability, greater flexibility in construction, less cost of labor and materials, as well as many other advantages. Although a single preferred embodiment has been described herein, many variations will be apparent to those skilled in the art. It is, therefore, intended that the scope of the invention be limited only by the claims which follow.

I claim:

1. An offshore drilling unit of the self-elevating type having a floatable hull and a plurality of legs movable from a raised position, in which said legs are supported by said hull in a body of water, to a lowered position, in which the hull is supported by said legs on the floor of said body of water; said legs comprising a plurality of mutually parallel tubular chord members rigidly interconnected by structural bracing members, said tubular chord members comprising elongated tubular body means and elongated plate means, lying in a plane including the longitudinal axis of said tubular body means, rigidly connected to and spanning the interior of said tubular body means, the thickness of said plate means varying depending on its longitudinal position in said chord member, the wall thickness of said tubular body means being substantially uniform throughout the length of said chord member; said chord member comprising rack means, having at least one set of rack teeth thereon, projecting radially away from said tubular body means in a plane substantially corresponding with the plane of said plate means.

2. An offshore drilling unit as set forth in claim 1 in which said structural bracing members comprise horizontal and inclined structural members interconnected by K-shaped tubular connector joints.

3. An offshore drilling unit as set forth in claim 2 in which said horizontal and inclined structural members are connected to said chord members by tubular connector joints, welded between sections of said chord members, having tubular body means and elongated plate means spanning the interior thereof.

4. An offshore drilling unit of the self-elevating type having a floatable hull and a plurality of legs movable from a raised position, in which said legs are supported by said hull in a body of water, to a lowered position, in which the hull is supported by said legs on the floor of said body of water; said legs comprising a plurality of mutually parallel tubular chord members rigidly interconnected by structural bracing members, said tubular chord members comprising elongated tubular body means and elongated plate means, lying in a plane including the longitudinal axis of said tubular body means, rigidly connected to and spanning the interior of said tubular body means, said chord members comprising a pair of rack members, each of which is provided with a set of rack teeth, one rack member being on one side of said tubular body means and the other on the opposite side of said tubular body means and projecting radially away from said tubular body means in a plane substantially corresponding with the plane of said plate means.

5. An offshore drilling unit as set forth in claim 4 in which said tubular body means comprises a pair of semi-cylindrical members between the longitudinally disposed ends of which are welded said rack members, said plate member being welded between said rack members.

6. An offshore drilling unit as set forth in claim 4 comprising power means carried by said hull having gear means engageable with said sets of rack teeth on said rack members for moving said legs between said raised and lowered positions.

7. An offshore drilling unit as set forth in claim 6 in which each of said legs is triangular in cross section and comprises three of said chord members one at each corner of said triangular cross section.

8. An offshore drilling unit of the self-elevating type having a floatable hull; a plurality of legs movable from a raised position, in which said legs are supported by said hull in a body of water, to a lowered position, in which said hull is supported by said legs on the floor of said body of water; and elevating means carried by said hull and operatively engageable with said legs for moving said legs between said raised and lowered positions; said legs comprising a plurality of mutually parallel tubular chord members, rigidly interconnected by structural bracing members, and rack means longitudinally disposed along said chord members and having sets of rack teeth on the faces thereof projecting radially outward from said chord members in a plane containing the longitudinal axis of said tubular chord members, said rack means being engaged by said elevating means for movement of said legs between said raised and lowered positions, said tubular chord members comprising elongated reinforcing plates longitudinally disposed along and spanning the interior thereof in said plane containing said longitudinal axis of said tubular chord members.

9. An offshore drilling unit of the self-elevating type having a floatable hull; a plurality of legs movable from a raised position, in which said legs are supported by said hull in a body of water, to a lowered position, in which said hull is supported by said legs on the floor of said body of water; and elevating means carried by said hull and operatively engageable with said legs for moving said legs between said raised and lowered positions; said legs comprising a plurality of mutually parallel tubular chord members, rigidly interconnected by structural bracing members, and rack means longitudinally disposed along said chord members and having sets of rack teeth on the faces thereof projecting radially outward from said chord members in a plane containing the longitudinal axis of said tubular chord members, said rack means being engaged by said elevating means for movement of said legs between said raised and lowered positions, said tubular chord members comprising a pair of semi-cylindrical members between the opposing ends of which are welded the backs of said rack means to form a rigid cylindrical construction.

10. An offshore drilling unit as set forth in claim 9 in which said chord members comprise a reinforcing member longitudinally disposed along the interior of said cylindrical construction between said rack means back and in a plane coinciding with the plane of said rack means.

11. An offshore drilling unit as set forth in claim 10 in which the wall thickness of said semi-cylindrical members are substantially uniform throughout the length of said legs but in which the thickness of said reinforcing member varies depending on its longitudinal position within said legs.

12. An offshore drilling unit as set forth in claim 10 in which the plane in which said rack means and reinforcing member lie is parallel to but spaced away from the longitudinal centerline of said legs.

13. An offshore drilling unit as set forth in claim 10 in which said elevating means comprises at least a pair of pinion members, one of which engages a set of rack teeth on one side of said chord member and the other of which engages a set of rack teeth on the diametrically opposite side of said chord member.

14. An offshore drilling unit as set forth in claim 8 in which said structural bracing members comprise horizontal and inclined tubular members interconnected by welding to a tubular cast K-shaped joint.

15. An offshore drilling unit as set forth in claim 14 in which said horizontal and inclined tubular bracing members are connected to said chord members by welding to tubular cast chord joints welded between sections of said chord members.

16. An offshore drilling unit as set forth in claim 15 in which said chord joints comprise a tubular trunk portion from which radially projects horizontal tubular branch portions and inclined tubular branch portions for connection with said horizontal and inclined bracing, respectively.

17. An offshore drilling unit as set forth in claim 16 in which said tubular trunk portion is provided with a reinforcing member spanning the interior of said trunk portion in a plane which includes the central longitudinal axis of said chord member.

* * * * *